United States Patent [19]

Kleiner

[11] 4,000,761

[45] Jan. 4, 1977

[54] DEVICE FOR CONTROLLING THE SEQUENCE OF MOVEMENT OF INDIVIDUAL HEDDLE FRAMES OF A WEAVING MACHINE

[75] Inventor: Walter Kleiner, Zurich, Switzerland

[73] Assignee: Staeubli Ltd., Horgen-Zurich, Switzerland

[22] Filed: June 26, 1975

[21] Appl. No.: 590,435

[30] Foreign Application Priority Data

July 1, 1974 Switzerland ..... 9016/74

[52] U.S. Cl. ..... 139/66 R

[51] Int. Cl.[2] ..... D03C 1/00

[58] Field of Search ..... 139/66–74, 139/79

[56] References Cited

UNITED STATES PATENTS

| | | | |
|---|---|---|---|
| 3,349,808 | 10/1967 | Gustafson et al. | 139/66 R |
| 3,468,347 | 9/1969 | Fumat | 139/66 R |
| 3,724,511 | 4/1973 | Kleiner | 139/66 R |
| 3,726,323 | 4/1973 | Kleiner | 139/66 R |
| 3,730,231 | 5/1973 | Hoenig | 139/66 R |

FOREIGN PATENTS OR APPLICATIONS

| | | | |
|---|---|---|---|
| 315,728 | 10/1971 | U.S.S.R. | 139/66 R |
| 320,577 | 1/1972 | U.S.S.R. | 139/66 R |

*Primary Examiner*—James Kee Chi

*Attorney, Agent, or Firm*—Woodhams, Blanchard and Flynn

[57] ABSTRACT

There is provided a device for either advancing or retracting the relative movement of a dobby with respect to the heddles of a weaving machine or with respect to any one or selected ones of such heddles. Thus, the shed-intersection point within said weaving machine may be advanced or retarded with respect to the dobby with resulting desirable modifications in the finished fabric. Same is accomplished by driving both the dobby and the heddle or heddles through a pair of levers and including a device by which the angle between said levers can be modified in order to modify the operational phase angle between such dobby and such heddle or heddles.

9 Claims, 9 Drawing Figures

DEVICE FOR CONTROLLING THE SEQUENCE OF MOVEMENT OF INDIVIDUAL HEDDLE FRAMES OF A WEAVING MACHINE

FIELD OF THE INVENTION

The invention relates to a device for modifying the sequence of movement of individual heddle frames of a weaving machine with respect to their normal movement therein, which movements are determined by a dobby. There is positioned rotatably on a drive shaft at least one eccentric disk and a movement lever is mounted thereon, said eccentric disk supporting a catch which couples through appropriate means the eccentric disk in a control relationship with the drive shaft or the movement lever and the movement lever carries out a translatory movement which corresponds to the magnitude of the eccentricity of the eccentric disk, such movement controlling the movement of the heddle frame.

BACKGROUND OF THE INVENTION

To achieve special effects in the fabric or a protective thread intersection or an early or delayed enmeshing or anchoring of the weft thread, it is known to modify, during a weaving operation, the conventional heddle frame movement. In this connection, the conventional heddle frame movement is the simultaneous intersection of all heddle frames and the time of the insertion of a pick with respect to the heddle frame movement.

With changed heddle frame movement, it is desirable first to modify the movement phase in the area of the shed end by having the passage of the warp threads, or a part of the warp threads, through this point take place either earlier or later.

In dobbies various solutions have been used, which are based on the principle of effecting a change from the original heddle frame movement by means of a lever drive, which lever drive resulted in a distortion of such original movement. Instead of the lever drive, sliders have also been used. Such solutions caused considerable deterioration from the optimum acceleration law realized in the original heddle frame movement. The consequence was an increased wear on machines and fabrics. In addition, the additional gear parts resulted in more mass to move, friction and play. Due to the increases of the weaving speeds, better solutions have always been sought, which were used in particular in dobbies with a rotatable drive instead of the reciprocally swinging gears.

The purpose of the invention is to provide simple adjusting means which is exposed to no wear and functions satisfactorily at high speeds.

SUMMARY OF THE INVENTION

This is achieved in the device of the above-mentioned type, which is characterized inventively by both the drive shaft and the movement lever having means for adjusting their coupling means with respect to the normal position.

In this manner, the catch and the raster element can be moved or rotated with respect to the eccentric shaft at a phase shift value in the heddle frame movement or an angle, whereby at least the catch rings mounted on the eccentric shaft can be operated for the purpose of adjusting elements which are arranged outside of the machine housing.

BRIEF DESCRIPTION OF THE DRAWINGS

Exemplary embodiments of the subject matter of the invention are illustrated in the drawings, in which.

DETAILED DESCRIPTION

Figure 1:
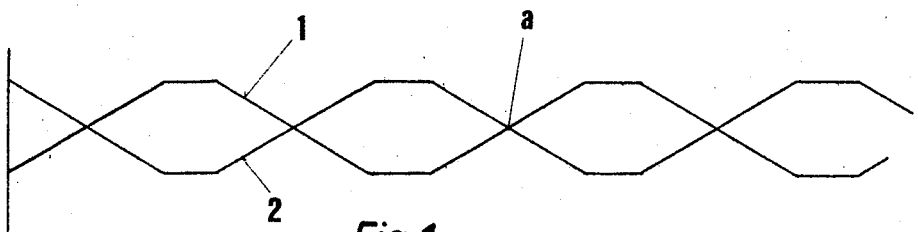
Fig.1 PRIOR ART
FIGS. 1 to 3 illustrate three different heddle frame movement diagrams of both conventionally and inventively moved heddles.

FIG. 1 illustrates the movement diagram of the conventional movement of two heddle frames 1 and 2. The shed-intersection point of all heddle frames is identified by *a*. The same illustration can be found in FIG. 2 with the shed-intersection point *a*. A second dash-dotted curve of two heddle frames 3 and 4 shows a leading phase shift $+\alpha$ with respect to the two first curves 1 and 2. The shed-intersection point is identified here as *b*. FIG. 3 illustrates a similar situation but here the curves of the heddle frames 30 and 40 have movement time which follows at $-\alpha$ with respect to the curves 1 and 2.

Figure 2:
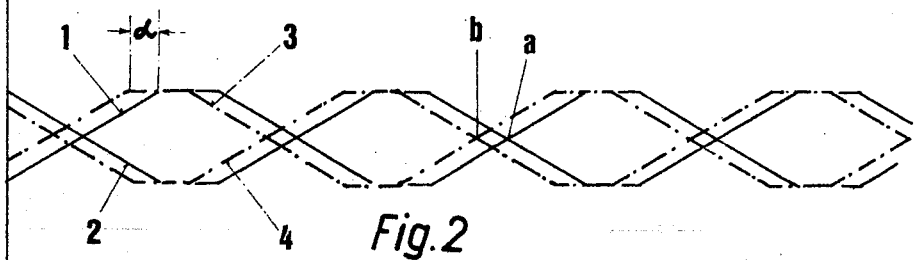
Figure 3:
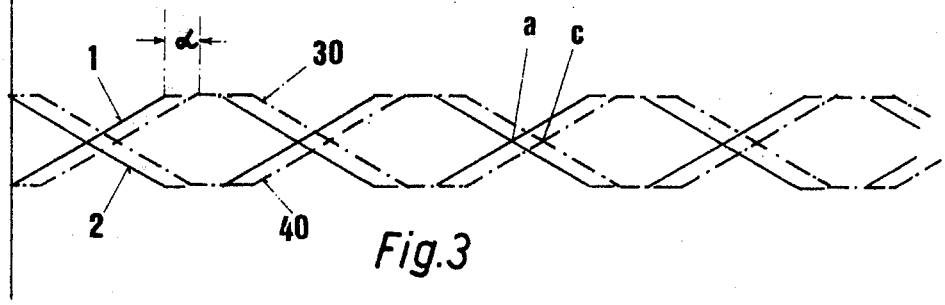

From the diagrams one can see that in one and the same weaving machine all movement operations according to FIGS. 1, 2 and 3 can take place simultaneously. Also, the value of the phase shifts $\alpha$ may differ.

The hereinafter described devices in rotary dobbies permit such phase shifts to be individually adjusted for each heddle frame quickly and easily.

Figure 4:
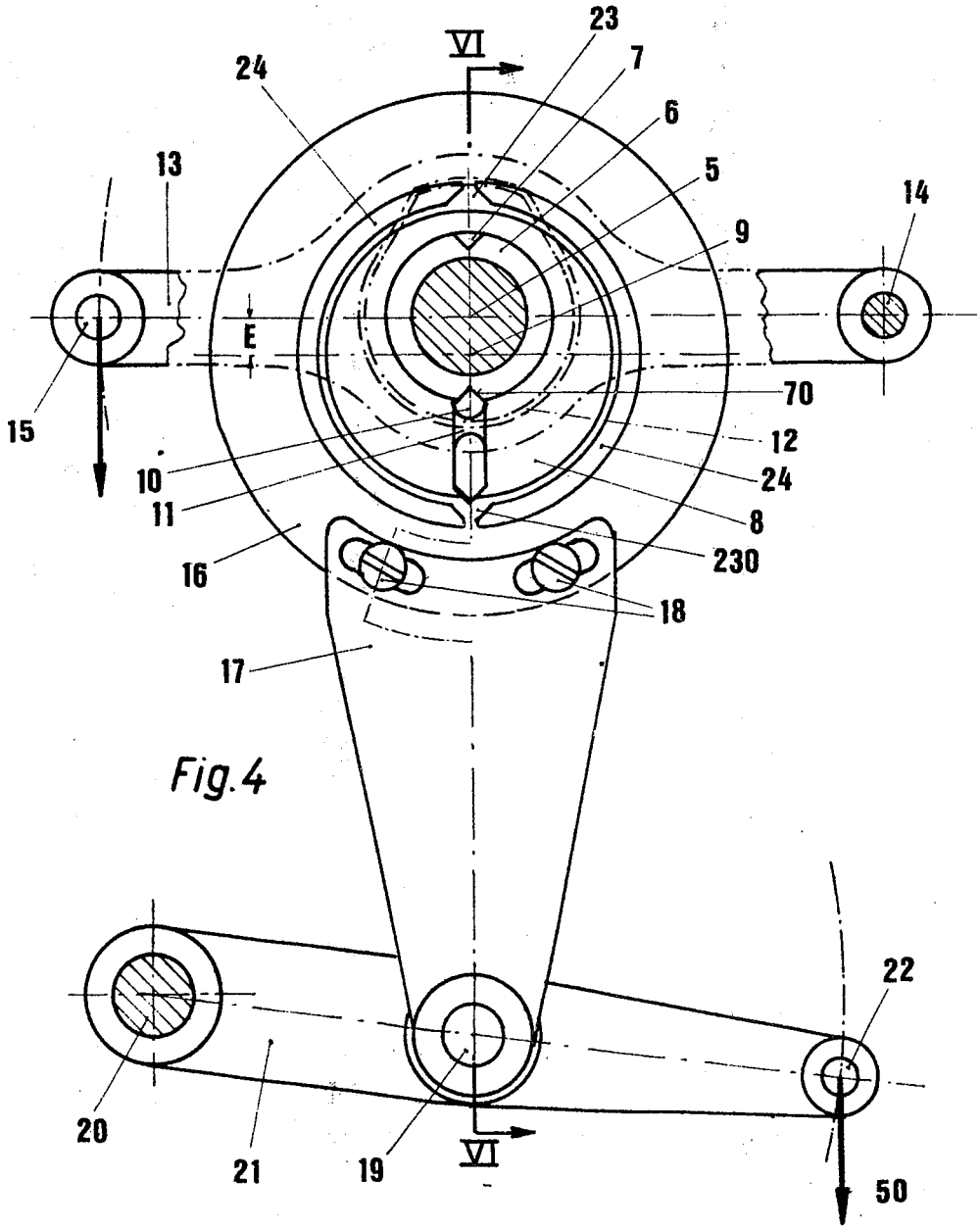
FIG. 4 illustrates the actual heddle frame movement mechanism of one heddle frame lifting unit, as is known from Swiss Pat. No. 512,605 (corresponds to U.S. Pat. No. 3,724,511)
Figure 5:
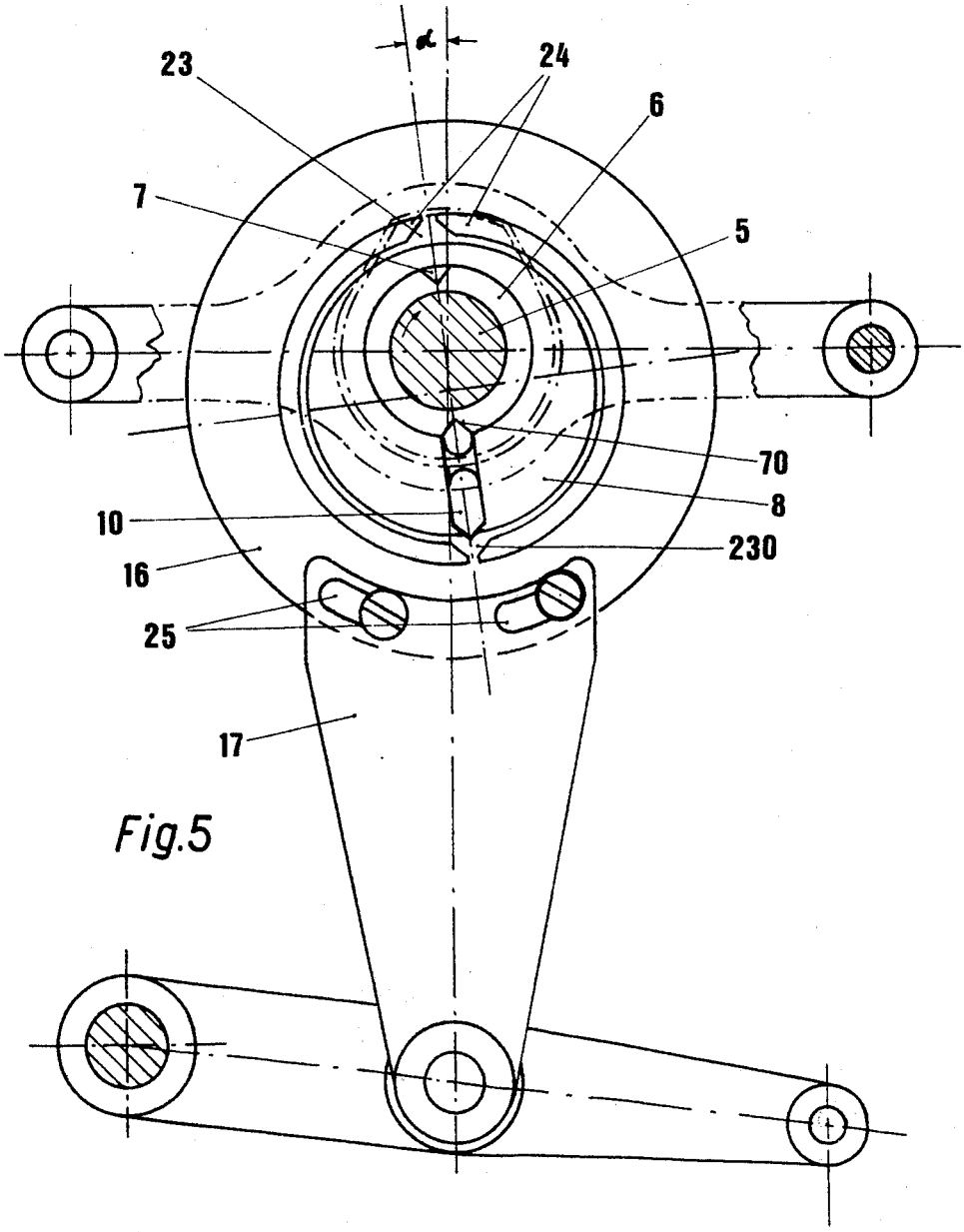
FIG. 5 illustrates the same mechanism after an adjustment with respect to the controlled heddle frame movement.
Figure 6:
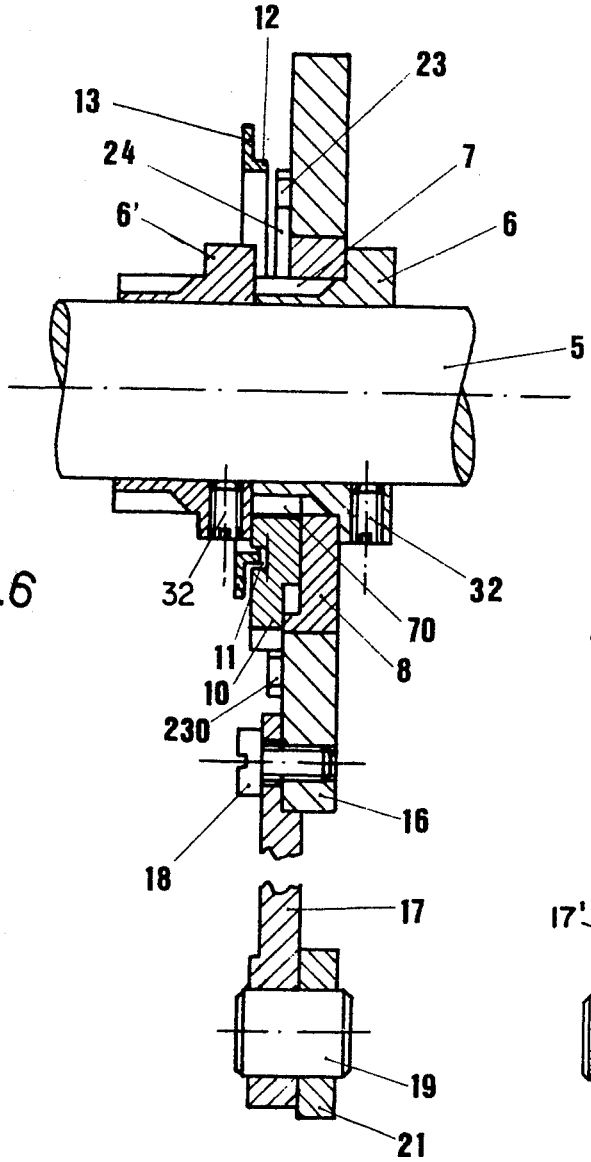
FIG. 6 is a cross-sectional view in an enlarged scale along the line VI—VI of FIG. 4.

FIGS. 4 and 5 illustrate the same views of two shed-forming mechanisms which are adjusted at this angle $\alpha$, as they have become known by Swiss Pat. No. 512,605 (corresponds to U.S. Pat. No. 3,724,511) and other patents of the same applicant. With the adjustment according to FIG. 4, one obtains the curves 1 or 2 in FIG. 1, with the adjustment according to FIG. 5, one obtains the curves 3 and 4. FIG. 6 serves the further explanation of the mechanical structure.

On the drive shaft 5, which for each pick carries out half a rotation, there is clamped, by means of the set screw 32, the catch ring 6, which has the two oppositely positioned engaging grooves 7,70. The eccentric disk 8 is supported freely rotatably on this catch ring, which eccentric disk 8 has its center at reference numeral 9 (FIG. 4). The wedge 10 is supported radially movably on said eccentric disk. The collar 12 of the control lever 13 continuously engages the groove 11 of this wedge, which control lever in turn is supported pivotally on the shaft 14. The control lever is connected by the eye 15 to a not illustrated control apparatus of a dobby.

A connecting rod assembly 160 is comprised of a ring 16 and lever 17. The ring 16 is supported rotatably on the eccentric disk 8 and the lever 17 is secured to the ring 16 through the screws 18. The lever 17 itself is supported pivotally through a bolt 19 on a swivel arm 21, so that ring 16 and lever 17 can also participate in the translatory eccentric movement of the eccentric disk 8 and thereby carry along the swivel arm 21. The arm 21 is pivotal about the axis of a shaft 20 and its movement carries through an eye 22 thereon a schematically illustrated draw rod 50 to the not illustrated heddle frame. The eccentric disk 8 has two approximately semicircular resilient raster clips 24, which form on each of their ends the grooves 23 and 230 for the other end of the wedge 10.

The wedge 10 is controlled according to a pattern for movement into engagement with one of the two grooves 7,70 or one of the grooves 23,230 through the control lever 13.

The continuously or discontinuously rotating drive shaft 5 rotates the eccentric disk 8 when the wedge 10 engages one of the engaging grooves 7,70. The eccentric disk carries out thereby half a rotation, which acts onto the ring 16, which is prevented from rotation by the lever 17, as an approximately translatory movement of the eccentricity amount of 2E. This movement effects the adjustment of the heddle frame from the upper shed position to the lower shed position, respectively vice versa.

If the heddle frame is now to be moved according to a dash-dot curve in FIG. 2 or 3, after loosening the screws 18, the ring 16 is rotated at the angle $\alpha$ on the eccentric disk 8, until the screws 18 each rest on one end of the slots 25, whereupon they are again tightened. With rotation of the ring 16, the grooves 23 and 230 are also shifted laterally. Simultaneously therewith, and after loosening the set screw 32, the catch ring 6 is rotated at the angle $\alpha$ on the drive shaft 5 and is again clamped thereto by tightening the set screw 32. This provides the position according to FIG. 5.

The shed-forming mechanism operates in the same manner. During a discontinuous drive the shaft 5 is always stopped at the same time and in the same position.

From the position of the wedge 10 which has been swung at the angle $\alpha$ and the also rotated eccentric 8, it can be seen that the eccentric after one-fourth rotation of the eccentric shaft has assumed a position which is changed for the value $\alpha$, and therefore same also achieves a shed-intersection point delayed for $\alpha$.

Instead of pivoting the ring 16 relative to the eccentric disk 8 and the lever 17, it is also sufficient to rotate the raster clips 24 on the ring 16 for the amount of $\alpha$ in the one or other direction in order to achieve the same effect.

Depending on the size of the angle $\alpha$ in FIG. 5, the curves 3 and 4 shift relative to the curves 3,30 in FIGS. 2 and 3.

Figure 7:
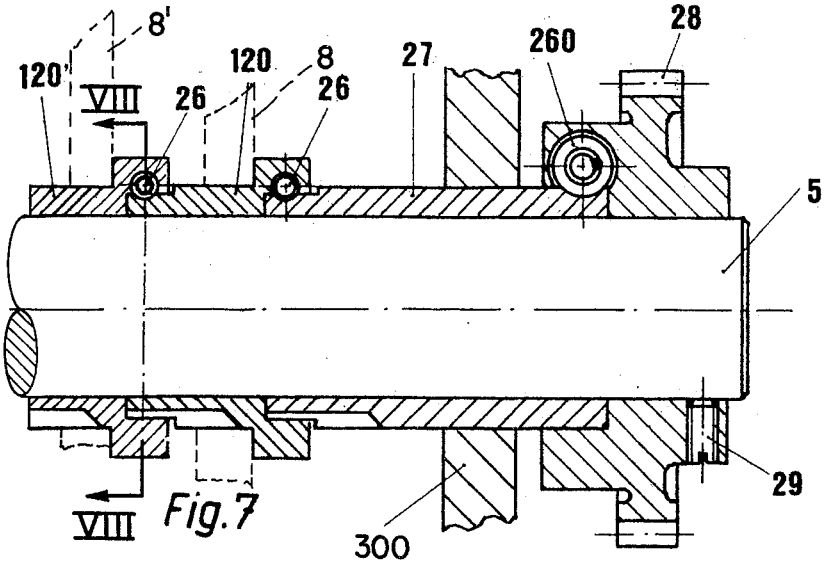
FIG. 7 is a longitudinal cross-sectional view of the drive shaft of a modification of a dobby for driving several heddle frames.
Figure 8:
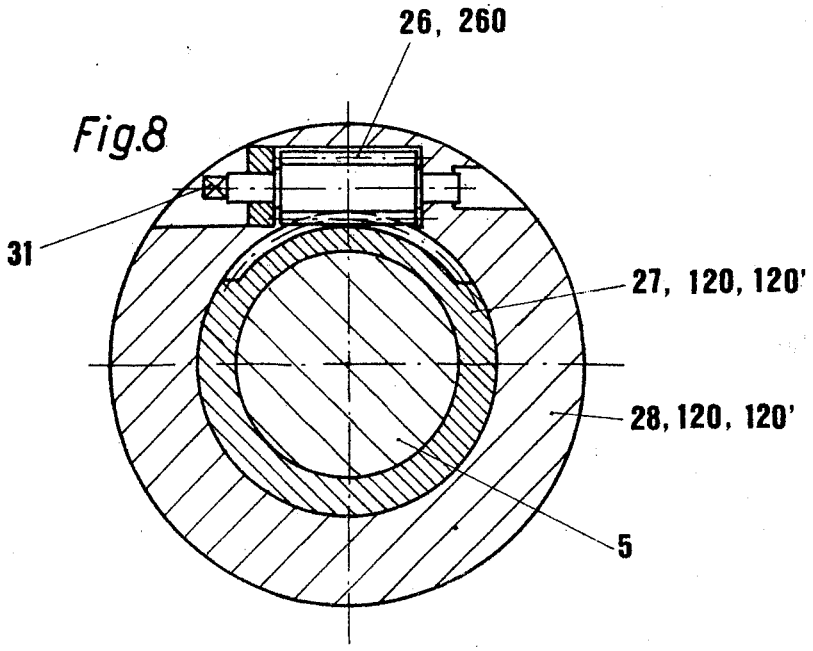
FIG. 8 is a cross-sectional view along the line VIII—VIII of FIG. 7.

FIGS. 7 and 8 show a modification of the securement of a plurality of catch rings 27,120,120' on the drive shaft 5. A pair of eccentrics 8 and 8' are schematically mounted on the catch rings 26 and 26', respectively. Side-by-side positioned rings 120,120' engage one another, whereby the last ring 120 engages the sleeve 27. The connection is effected through worms 26 and 26'.

By rotating the worm 26, both engaging catch rings 120,120' are rotated at an angle in the direction of $\alpha$ with respect to one another or to the sleeve 27. At the end of the eccentric shaft 5 there is positioned, and held nonmovably, the screw 29, the gear 28, which is driven through not illustrated members by the weaving machine. At the contact point of this gear with the sleeve 27 there is provided a worm 260, which connects both parts controllably but fixed with respect to rotation. The sleeve extends through the housing 300 of the dobby. By means of the worms 260, it is possible to rotate the catch rings 27,120,120' from outside of the machine housing to adjust each to the same angle $\alpha$.

As is shown in FIG. 8, the ends of the axes of the worms 26,26',260 can be constructed to have a rectangular cross section. The rotary shifting of each worm 26,26',260 to the angle $\alpha$ may take place from outside of the dobby by the use of a not illustrated tool adapted to engage the end 31. The worm may advantageously have a self-locking pitch. Through this the reciprocal position of the catch rings remains unchanged through the entire weaving operation.

By means of the worm 260 it is possible to adjust at the same time all catch rings 27,120,120' of a drive shaft 5. The individual adjustment of the individual catch rings 120 and 120' is effected through the associated worms 26 and 26'.

One or more eccentric disks 8 can be supported rotatably or couplably on a single catch ring. However, it is also possible to position eccentric disks fixedly, namely not couplable or uncouplable, on the catch rings, which is particularly advantageous, if the same heddle frame movement is repeated continuously.

Figure 6A:
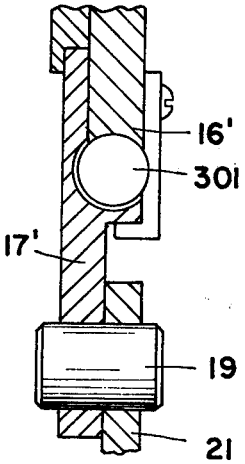
FIG. 6A is a fragmentary cross-sectional view of a modified connection between the ring and lever.

The above-mentioned self-locking worm drive 301 (FIG. 6A) may also be arranged between the ring 16' and the lever 17' - instead of the slot 25 and the screws 18 in FIGS. 4,5.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a coupling device for controlling the sequential movement of the individual heddle frames of a weaving machine having a rotatable drive shaft, an eccentric ring mounted for free rotation relative to said drive shaft, catch ring means mounted on said rotatable shaft and for rotation therewith, connecting rod means having means defining an opening therein and adapted to rotatably receive said eccentric ring means therein, catch means radially movable toward and away from said catch ring means for effecting a selective connecting of said eccentric ring to said drive shaft and effecting a rotation of said eccentric ring with said drive shaft and a movement of said connecting rod in response to a driven rotation of said eccentric ring, the improvement comprising adjusting means for adjusting the moment in time in a cycle of operation of said machine that said connecting rod is moved.

2. The improved coupling device according to claim 1, wherein said adjusting means comprises first means for facilitating rotation of said catch ring means a selected arcuate segment relative to said drive shaft, said catch ring means having means defining at least one groove therein, the relative position of which becomes changed when said catch ring means is rotated relative to said drive shaft and second means for adjusting the radial path of movement of said catch means to maintain a radial alignment with said groove.

3. The improved coupling device according to claim 2, wherein said catch ring means includes a ring encircling said drive shaft; and wherein said first means includes set screw means for securing said ring to said shaft.

4. The improved coupling device according to claim 2, wherein said catch ring means includes a ring encircling said drive shaft; and wherein said first means includes self-locking worm gear means between said ring and said drive shaft.

5. The improved coupling device according to claim 4, wherein said catch ring means includes a plurality of separate rings all encircling said drive shaft; and wherein said first means includes a plurality of self-locking worm gear means series connecting mutually adjacent ones of said rings.

6. The improved coupling device according to claim 2, wherein said connecting rod means includes a ring encircling said eccentric ring and having a lever secured thereto; and wherein said second means includes a radial guide on said eccentric ring for guiding said radial movement of said catch means and arcuately adjustable fastening means for securing said lever to said ring, said ring being rotatable through said adjustable fastening means with said eccentric ring relative to said lever to align the radial path of said catch means with said groove in said catch ring means.

7. The improved coupling device according to claim 6, wherein said arcuate adjustable fastening means includes means defining at least one arcuate slot on said lever and at least one screw secured to said ring received in said arcuate slot and slidable relative thereto.

8. The improved coupling device according to claim 6, wherein said arcuate adjustable fastening means includes self-locking worm gear means between said ring and said lever.

9. The improved coupling device according to claim 8, wherein said ring has means defining at least one second groove periodically aligned with said path defined by said radial guide and periodically becoming engaged with said catch means.

* * * * *

UNITED STATES PATENT AND TRADEMARK OFFICE

CERTIFICATE OF CORRECTION

PATENT NO. : 4 000 761

DATED : January 4, 1977

INVENTOR(S) : Walter Kleiner

It is certified that error appears in the above-identified patent and that said Letters Patent are hereby corrected as shown below:

Column 6, line 18; change "8" to ---6---.

Signed and Sealed this

Fifteenth Day of March 1977

[SEAL]

*Attest:*

RUTH C. MASON
*Attesting Officer*

C. MARSHALL DANN
*Commissioner of Patents and Trademarks*